US007240402B2

(12) United States Patent
Suzuki et al.

(10) Patent No.: US 7,240,402 B2
(45) Date of Patent: Jul. 10, 2007

(54) HINGE STRUCTURE FOR CONTAINER

(75) Inventors: Kazuo Suzuki, Koto-ku (JP); Shinji Shimada, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/480,936

(22) PCT Filed: Aug. 30, 2002

(86) PCT No.: PCT/JP02/08785

§ 371 (c)(1),
(2), (4) Date: Feb. 2, 2004

(87) PCT Pub. No.: WO03/018421

PCT Pub. Date: Mar. 6, 2003

(65) Prior Publication Data

US 2004/0123426 A1 Jul. 1, 2004

(30) Foreign Application Priority Data

Aug. 31, 2001 (JP) ..... 2001-264510
Aug. 31, 2001 (JP) ..... 2001-264511

(51) Int. Cl.
*E05D 11/10* (2006.01)

(52) U.S. Cl. ..... 16/330; 16/329; 16/267; 16/266; 132/293; 132/286; 220/836; 220/844

(58) Field of Classification Search ..... 16/330, 16/329, 331, 319, 335, 266, 262, 225, 260, 16/261; 220/264, 844, 835, 836, 840, 843; 132/293 X, 286 X; 4/236, 240
See application file for complete search history.

(56) References Cited

U.S. PATENT DOCUMENTS 3,333,726 A * 8/1967 Belanger ..... 220/836
4,349,120 A * 9/1982 DiNardo ..... 220/840

(Continued)

FOREIGN PATENT DOCUMENTS

JP 54-108199 A 8/1979

(Continued)

*Primary Examiner*—Brian E. Glessner
*Assistant Examiner*—Mark Williams
(74) *Attorney, Agent, or Firm*—Oliff & Berridge, PLC

(57) ABSTRACT

A hinge includes first hinge connectors having first shaft holes drilled and which are disposed at a rear of a synthetic resin case body that may contain a cosmetic material; a second hinge connector having a second shaft hole drilled and which is disposed at a rear of a synthetic resin lid that opens or closes with respect to the case body. The hinge also includes synthetic resin hinge shafts inserted through the first shaft holes, the second shaft hole, and two protruded fitting parts with a shape of a short cylinder disposed so as to project from end faces of the first hinge connectors and come in abutment with two U-shaped, recessed fitting parts disposed on end faces of the second hinge connector. The recessed fitting parts have an opening to a front side the lid, the opening having a width substantially equal to a diameter of the protruded fitting parts, the recessed fitting parts having a center of curvature that corresponds to a center of the second shaft hole and have a radius of curvature of substantially the same radius of curvature the protruded fitting parts. The hinge prevents shearing forces from acting on the hinge shafts and protects the hinge shafts against shearing fracture.

2 Claims, 12 Drawing Sheets

U.S. PATENT DOCUMENTS

| | | | | | |
|---|---|---|---|---|---|
| 4,693,392 | A | * | 9/1987 | Contreras, Sr. | 220/827 |
| 4,917,131 | A | * | 4/1990 | Contreras, Sr. | 132/301 |
| 5,320,239 | A | * | 6/1994 | Favre | 220/830 |
| 5,344,037 | A | * | 9/1994 | Favre | 220/264 |
| 5,992,426 | A | * | 11/1999 | Yuhara | 132/293 |
| 6,021,784 | A | * | 2/2000 | Yuhara | 132/293 |
| 6,129,089 | A | * | 10/2000 | Yuhara | 132/300 |

FOREIGN PATENT DOCUMENTS

| | | | |
|---|---|---|---|
| JP | 3-34413 | A | 2/1991 |
| JP | 11-285411 | A | 10/1999 |
| JP | 11-290118 | A | 10/1999 |
| JP | 2001-104047 | A | 4/2001 |
| JP | 2002-262927 | A | 9/2002 |

* cited by examiner (a)

(b)

(c)

HINGE STRUCTURE FOR CONTAINER

BACKGROUND

1. Field of Invention

This invention is related to a hinge structure of a case, intended to join a case body and a lid together by means of a hinge in a manner capable of opening, turning, and closing the lid, and in particular, to a hinge structure that prevents a shearing force from acting onto the hinge shafts.

2. Description of Related Art

A compact case is used to take along a cosmetic material, such as a foundation, and the case includes a case body in which to contain a cosmetic material, and a lid that covers the top surface of the case body. Because of lightness in weight, high processability, and low cost, many of the compact cases are made of synthetic resins.

As the synthetic resin compact cases for cosmetic use, there are known those compact cases in which the first hinge connector or connectors are combined with the second hinge connector or connectors. These connectors are disposed at the rear of the case body or the lid, and are provided with a hole or two holes into which a hinge shaft or two shafts are inserted to join the case body and the lid together in a manner capable of opening the lid, turning the lid from the position on the case body, and then closing the lid.

When a cosmetic compact case is used, the lid is turned around, with a hinge shaft or shafts serving as the axis or axes of rotation, and the front side of the lid is raised away from the case body. The lid is then stopped by the rear end of the case body at one point where the movement of the lid comes up to the limit of rotation.

Sometimes hinge shafts were broken if an external force acted on the lid in the lid-opening direction at the limit of rotation where the lid could no longer continue to turn relative to the case body. At those times, strong forces acted as shearing forces on the hinge shafts in which the portion pushed by the external force under the leverage served as the power point, while the hinge shafts that joined the case body and the lid together served as the point of action.

The case body and the lid are usually joined together with a hinge to improve the handling ability. Hinge shafts, one of the hinge components, are generally made of a metallic material because high mechanical strengths, such as toughness, are required for the hinge shafts.

However, in recent years, there was a greater demand than ever for the separate collection and disposal of synthetic resin products from a resources recycling point of view. If this demand should be met in compact cases, it is required to remove the metallic hinge shafts from the cases.

The hinge connection must not be easily slipped away. The lid should be securely held at any opening posture relative to the case body. Thus, the hinge shafts are often fitted tightly to shaft holes so that the shafts may have a frictional resistance of a certain level or higher between the shaft and the shaft hole. Therefore, it was difficult to take the hinge shafts out of the shaft holes. There was little choice but to break the hinges for the separate collection.

In the conventional art, P1999-290118 and P1999-285411 were disclosed to solve this problem of separate collection and waste disposal. Proposed in these patent applications were a compact case including a case body, a lid, and hinge pins, all made of synthetic resins. (See FIGS. 5-7.)

The hinge pins of synthetic resins disclosed in the conventional art have advantages in that the compact cases can be lightweight, that no separate collection and disposal are required because the hinge shafts, the case body, and the lid are made of the same materials, and that the production cost is less expensive. However, the hinge pins of synthetic resins have problems in that, because these pins are inferior to metallic ones in their rigidity and strength, the resinous pins cannot withstand the shearing force applied on the hinge pins, and that sometimes they are easily broken.

As shown in FIGS. 10-12, the cosmetic case of P1999-285411 includes a container 112 of a synthetic resin in which to contain a cosmetic material and a synthetic resin cover 114 to open or close the case body 112. Hinge blocks 116 and 118 are respectively disposed at the rear of the container 112 and the cover 114. Hinge pins 120 made of a synthetic resin are the axis of rotation for the cover 114 to turn relative to the container 112 and are inserted through the pinholes inside the hinge blocks 116 and 118. Collar flange 126 and circular boss 128 are disposed between the respective hinge blocks 116 of the container 112 and the hinge block 118 of the cover 114. The hinge pins 120 are inserted through these blocks so that the flange 126 and the boss 128 surround the hinge pins 120 and are engaged firmly with each other in a manner rotatable from each other.

The collar flange 126 is provided with a cut 130 through which the circular boss 128 is inserted in the radial direction.

Although, in that conventional art, synthetic resin pins have a lower strength than the metallic pins have, the breakage in the hinge pins 120 of a synthetic resin is prevented by allowing the collar flange 126 and the circular boss 128 to receive strong shearing forces that may act on the hinge pins 120.

When the circular boss 128 is fitted into the collar flange 126, the boss 128 is inserted through the cut-out section 130 in the flange 126. In this way, both of the boss 128 and the flange 126 are easily engaged with each other, and the circular boss 128 never slips away from the collar flange 126. Thus, the cover can be smoothly rotated on the hinge pins 120 that serve as the axis of rotation in the movement relative to the case body.

However, the above-described conventional art had a problem in that the width of the cut-out section 130 of the collar flange 126 had to be forcibly expanded and deformed up to the width equal to the diameter of the circular boss 128. This deformation of the hinge block 118 may lead to a risk of breakage.

A possible measure taken to avoid the breakage of the hinge blocks is to utilize a soft, highly deformable synthetic resin. However, if a soft synthetic resin is used for the hinge blocks or for the container, the poor feel of the material will result, and commercial value will drop. In addition, a problem arising from a soft material is that the hinge connection disrupts the stability, and often the opening/closing operations get out of order.

If a cut-out section is formed underneath the hinge blocks, as in conventional art, the cut-out is open downward when the compact case is carried in the state where the cover remains closed. If an external force acts unexpectedly on the cover in the direction that the cover is raised at the rear side, this external force cannot be received by the collar flange and the circular boss, but acts directly on the hinge pins as a shearing force. Thus, the breakage of hinge pins causes a problem.

SUMMARY

The first invention includes a hinge structure of a case, intended to join a synthetic resin case body and a synthetic resin lid together in a manner capable of opening, turning, and closing the lid, with the hinge including:

first hinge connectors, through which first shaft holes are drilled and which are disposed at the rear of the synthetic case body in which to contain a cosmetic material;

second hinge connector, through which a second shaft hole is drilled and which is disposed at the rear of the synthetic resin lid that opens or closes the case body; and two hinge shafts, which are made of a synthetic resin with each shaft being inserted through said first shaft hole and second shaft hole, wherein two protruded fitting parts in the shape of a short cylinder, with the center of the first shaft holes serving as the central axis, are disposed so as to protrude from end faces of the first hinge connectors that come in end-to-end abutment with the second hinge connector; and wherein two recessed fitting parts in a U shape are correspondingly disposed on end faces of the second hinge connector that comes in end-to-end abutment with the first hinge connectors, with the recessed fitting parts being open to the front side of the lid at almost the same width as the diameter of these protruded fitting parts, having the center of curvature that is identical with the center of each second shaft hole, and having a curve of the same curvature radius as that of the protruded fitting parts.

In the compact case of this invention, the case body and the lid are joined together in a manner capable of turning around the lid relative to the case body by means of a hinge structure including the first hinge connectors disposed at the rear of the case body, the second hinge connector disposed at the rear of the lid, and the hinge shafts that are inserted through the shaft holes drilled in both connectors.

Since all of the case body, the lid, and the hinge shafts are made of synthetic resins, the hinge shafts need not be removed when used compact cases are discarded.

For the assembly of the case body and the lid, both hinge connectors are aligned at positions that enable the protruded fitting parts to be smoothly engaged with the recessed fitting parts. Then, the hinge shafts are driven in both shaft holes. This procedure eliminates any forced deformation of the hinge connectors, and causes no breakage of these connectors.

Each recessed fitting part takes a posture to direct the open cut-out rearward when the lid has been turned to the opening limit where the rear side of the second hinge connector butts against the rear side of the case body. At that time, the circumferential surface of the protruded fitting part other than the surface exposed to the open cut-out is in contact with the inner arc surface of the recessed fitting part.

The rear side of the second hinge connector butts against the rear side of the case body at the lid-opening limit. Even if a strong external force acts on the hinge shafts in the shearing direction under the action of leverage with the butting position as the point of action and with a part of the lid as the power point, this external force acts on the hinge shaft from the front side, and is received totally by the protruded fitting part, the circumferential surface of which is in contact with the inner arc surface of the recessed fitting part. Therefore, the external force never acts on the hinge shaft as a shearing force, and there is no shearing fracture of the hinge shafts.

The recessed fitting part takes a posture to direct the open cut-out forward when the lid is in the closed state. In that case, the circumferential surface of the protruded fitting part other than the surface exposed forward to the open cut-out is in contact with the inner arc surface of the recessed fitting part.

Therefore, because of the engagement of the protruded fitting part with the recessed fitting part, the protruded fitting part comes to receive all the external force that pushes the lid to move from the case body in the direction other than the backward direction. Thus, this external force never acts on the hinge shafts as a shearing force. If the external force acts on the lid to move it backward away from the case body, such a force is received by the catching mechanism that retains the lid at the closed position and by a mechanism that maintains the lid at the closed state. Thus, no external force acts on the hinge shafts as a shearing force.

The second invention includes a hinge structure of a case, intended to join a synthetic resin case body and a synthetic resin lid together in a manner capable of opening, turning, and closing the lid, with the hinge including:

first hinge connector, through which a first shaft hole is drilled and which is disposed at the rear of the synthetic resin case body having powder storage;

second hinge connectors, through which second shaft holes are drilled and which are disposed at the rear of the synthetic resin lid that opens or closes the case body; and two hinge shafts made of a synthetic resin with each shaft being inserted through the first shaft hole and the second shaft holes, wherein overhanging ridges are disposed at the rear of the case body in the left and right parts other than where the first hinge connector is located, and wherein lid stops are disposed respectively at the rear of the second hinge connectors of the lid at positions opposite to said overhanging ridges that have been disposed at the rear of the case body and are allowed to butt against the overhanging ridges from underside when the lid is turned around fully from the position on the case body;

wherein stopping pieces are disposed on the inner end faces of the second hinge connectors of the lid, with the connectors being located in abutment with the first hinge connector, and wherein stopping mechanisms are disposed on both end faces of the first hinge connector of the case body at positions opposite to, and in contact with, the stopping pieces, and allow each stopping piece to butt against top contact surface from upside when the lid is turned around fully from the position on the case body.

When the lid is turned around with the hinge shafts as the axis of rotation so that the front end of the lid is raised away from the case body, each lid stop disposed at the rear of each second hinge connector of the lid also turns around until the lid stop comes to the front side of each hinge shaft. Then, the lid stop butts from underside against the opposite overhanging ridge disposed at the rear of the case body. On the rear side of hinge shafts, the stopping piece on each second hinge connector of the lid butts from upside against the top contact surface of each stopping mechanism disposed on each end face of the first hinge connector of the case body. As a result, the limit of rotation for the lid is set by the lid stops that turn around relative to the case body and by the two butting positions with the hinge shafts in between.

If external forces of some kind acts in the lid-opening direction onto either the case body or the lid at the limit of rotation, then the leverage may be observed with the portion pushed by the external force serving as the power point and both butting positions serving as the points of action. However, since the hinge shafts are located between both butting positions that serve as the points of action, these shafts cannot become the points of action, and thus, no shearing force acts on the hinge shafts.

The third invention includes the second invention, and also includes that each stopping mechanism is provided with a circumferential surface that comes into sliding contact with a stopping piece over the range in which the lid is rotatable relative to the case body.

If the lid is turned around relative to the case body, then the stopping piece slides along the circumferential surface of the stopping mechanism. Even if it happens that external forces are applied so as to push the stopping piece toward the circumferential surface of the stopping mechanism, this force applied onto the lid is received by the circumferential surface of the stopping mechanism by the intermediary of the stopping piece. Therefore, no external shearing force acts on the hinge shafts, thus preventing the hinge shafts from the shearing fracture during the time when the lid is being opened or closed.

DETAILED DESCRIPTION OF EMBODIMENTS

This invention is further described with respect to preferred embodiments, now making reference to the drawings. The compact case in the first embodiment, shown in FIGS. 1-4, is described.

The compact case 1 includes a case body 2 in which to contain a cosmetic material and which has a dish-like bottom, and also includes a lid 3 of a plate-like shape, which covers the top opening of the case body 2. Both the case body 2 and the lid 3 are made of a synthetic resin.

Figure 1:
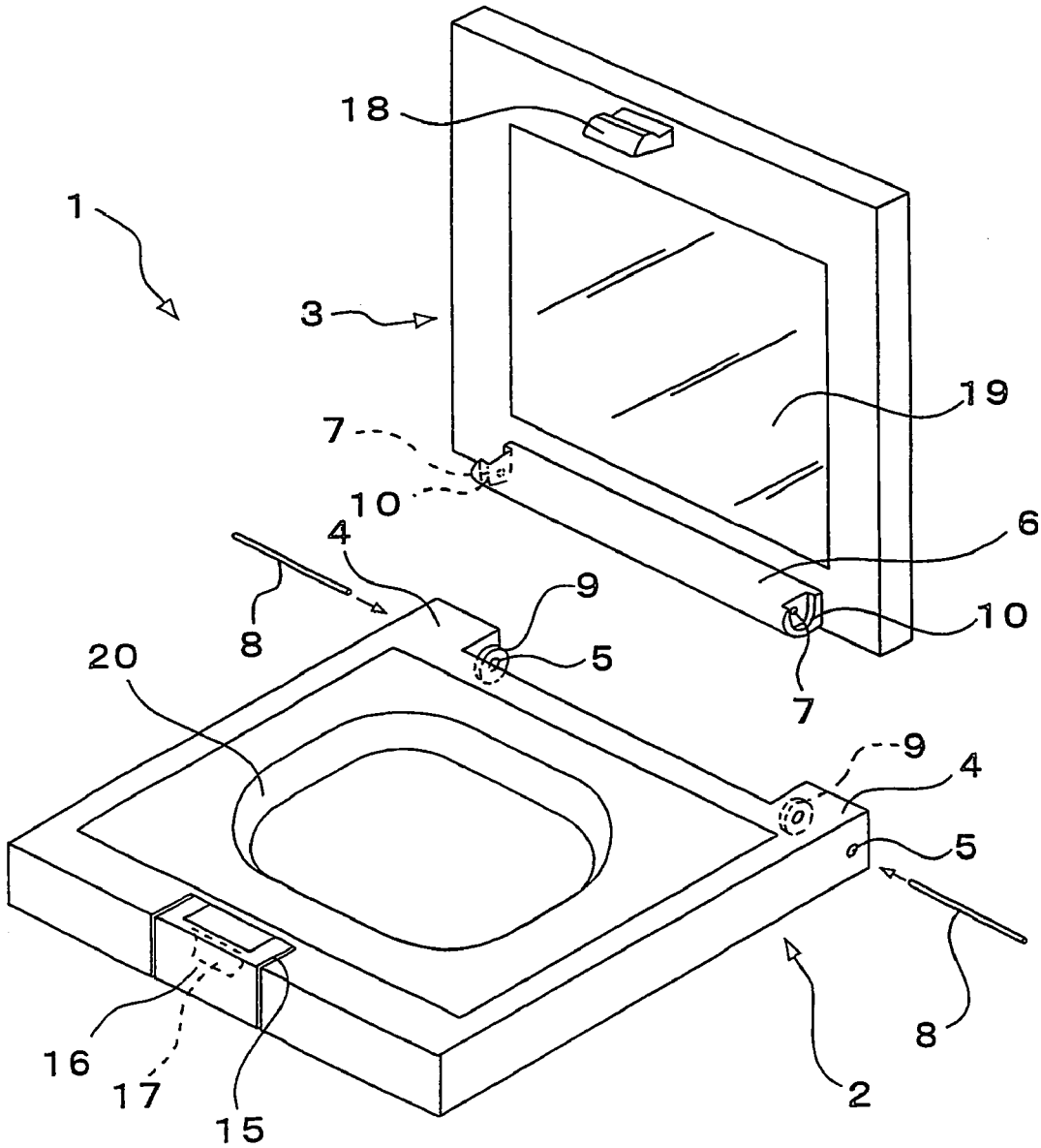
FIG. 1 is an entire exploded perspective view of the compact case in the first embodiment of this invention.

In FIG. 1, the compact case 1 is illustrated as being used to contain a cosmetic material in a detachable, refillable inside plate 20. However, the compact case of this invention is not limited to such use, but can also be used to contain a cosmetic material directly in the case body 2 or to put some make-up tools, along with the cosmetic material. In other words, the compact case 1 can be used suitably in response to the type of cosmetic products.

The case body 2 has a cut recession 15 in the center of the front side. The cut recession 15 is provided with projections (not shown) that face the right and left sides of the recession 15. These projections are used to support a lid-opening push button 16, which is made of a synthetic resin, molded into a horseshoe shape in cross-section, and is disposed in a rotatable manner. A catching portion 17 is disposed on, and projected from, the inner wall of the lid-opening push button 16.

The case body 2 has a pair of the first hinge connectors 4, which extends backward from the right and left end portions on the rear side of the case body 2. The first shaft hole 5 is drilled through each of the first hinge connectors 4 in the horizontal direction.

Figure 2:
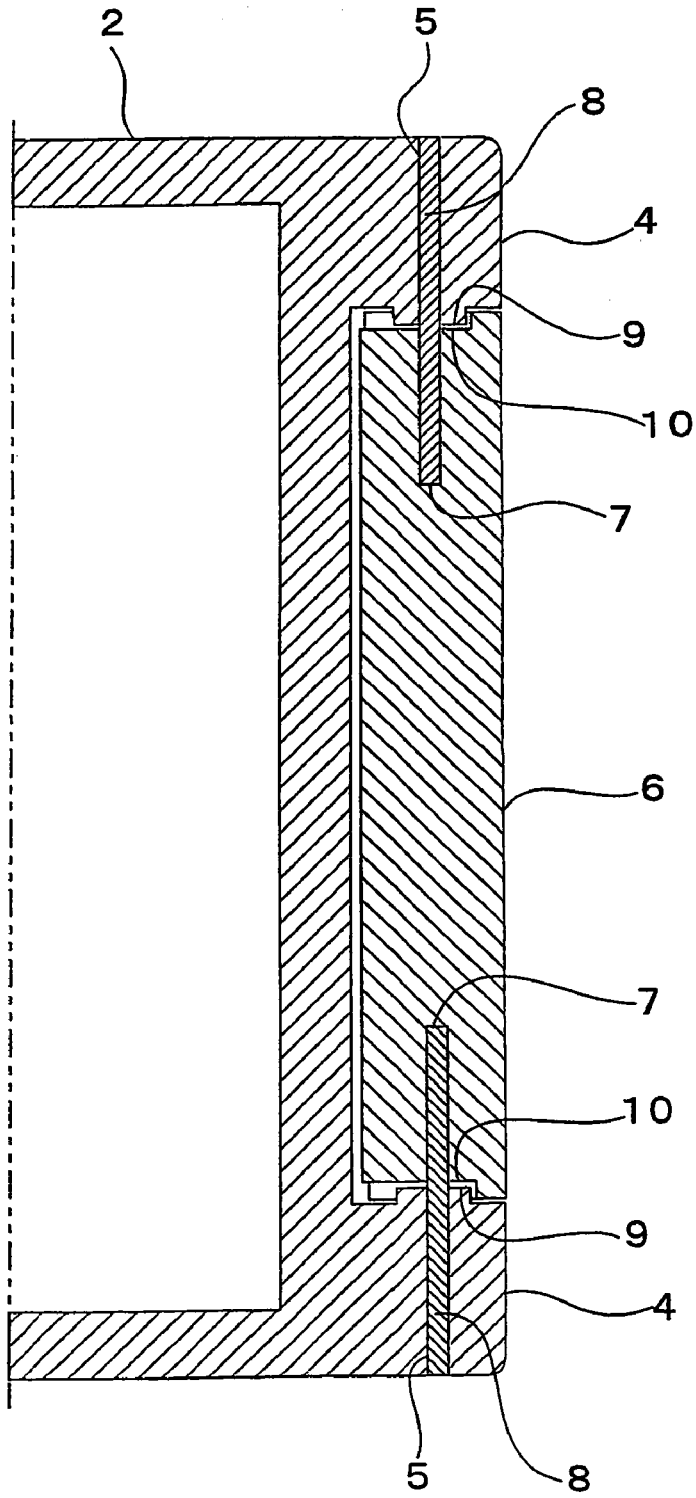
FIG. 2 is a cross-sectional plan view of the hinge connectors in the embodiment shown in FIG. 1 in which the case is in the closed state.

As shown in FIG. 2, protruded fitting parts 9 of a short cylindrical shape are disposed on the inner faces of the first hinge connectors 4, which stand opposite to each other and through which the first shaft holes 5 respectively pass from one end to the other end.

The lid 3 is provided with a catching piece 18, which is suspended from under the center of the front side. This catch 18 is fitted into the inside of the lid-opening push button 16 of a horseshoe shape and is engaged with the catching portion 17 when the lid 3 is in the closed state. The second hinge connector 6 is suspended from under the central portion close to the rear side of the lid 3. When the lid 3 is fitted to the case body 2, the second hinge connector 6 is aligned with, and in end-to-end abutment with, both of the first hinge connectors 4. The second shaft holes 7 are drilled through the second hinge connector 6 and are connected to both of the first shaft holes 5 when the lid 3 is fitted to the case body 2.

Figure 3:
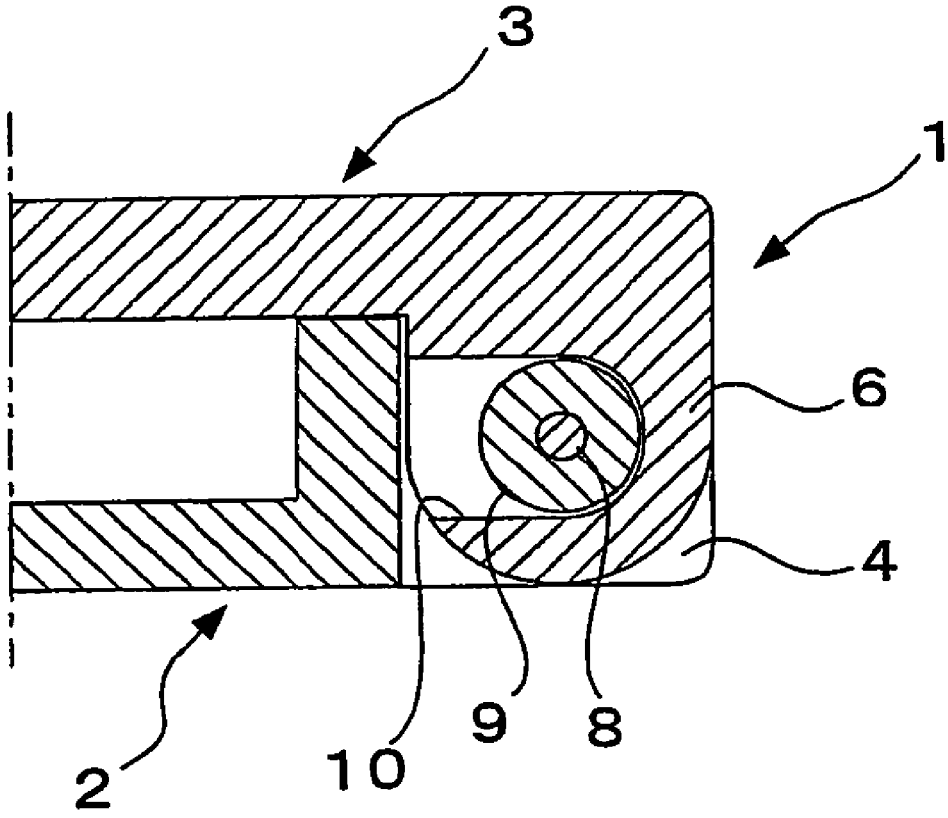
FIG. 3 is a cross-sectional side view of the hinge connectors in the embodiment shown in FIG. 1 in which the lid of the case is in the closed state.

As shown in FIG. 3, recessed fitting parts 10 in a U shape are disposed on both end faces of the second hinge connector 6. The recessed fitting parts 10 are open to the front side of the lid 3 at the same width as the diameter of the protruded fitting part 9, have the center of curvature that is identical with the center of the second shaft hole 7, and have a curve of the same curvature radius as that of the protruded fitting parts 9.

A mirror 19 is attached to the inner surface of the lid 3 detachably by an appropriate means, such as adhesion or inlet, so that the user can check on the makeup.

A tough hinge shaft 8 of a synthetic resin is inserted through the first shaft hole 5 and the second shaft hole 7 at each of the right and left end portions of the case width. The hinge shafts 8 have a diameter slightly larger than the diameter of the first shaft holes 5 and the second shaft holes 7.

For the assembly of the case body 2 and the lid 3, the open cut-outs of the recessed fitting parts 10 are first brought to the position close to the right and left protruded fitting parts 9. The protruded fitting parts 9 are accepted into the recessed fitting parts 10 through the U-shaped open cut-outs until the protruded fitting parts 10 get in contact with the curved surface of the recessed fitting parts 10. In that contact state, the first shaft holes 5 are in alignment with the second shaft holes 7.

In this way, the protruded fitting parts 9 are fitted into the recessed fitting parts 10 by a smooth inserting operation. There is no possibility that the open cut-outs of each recessed fitting part 10 is forcibly widened or deformed. Thus, this insertion procedure never causes any breakage in the open cut-outs of the recessed fitting parts 10 of the second hinge connector 6 at the time of assembly.

The hinge shafts 8 are then inserted forcibly into the shaft holes 5 exposed in the rear portions on both sides of the case body 2, and are pushed through into the second shaft holes 7. The hinge shafts 8 are tightly driven in the holes so that there will be a desired level of frictional resistance between the hinge shafts 8 on one hand and the first shaft hole 5 and the second shaft hole 7 on the other hand. The lid 3 is thus connected to the case body 2 by the hinge in a manner that the lid 3 is free to stop at any position.

At the time of makeup, the user pushes the lid-opening push button 16 to turn and move the catching portion 17 outward and to release the engagement between the catching portion 17 and the catching piece 18, and raises the lid 3 in the opening direction to open the compact case 1.

After the makeup is finished, the user turns the lid 3 back to the closed position, thrusts the catching piece 18 into the hole of the lid-opening push button 16, and allows the catching portion 17 to be engaged with the catching piece 18 to close the compact case 1. It should be understood that the catching mechanism of the lid 3 is not limited to the embodiment shown in FIG. 1, but can be any other appropriate form of the catch.

Figure 4:
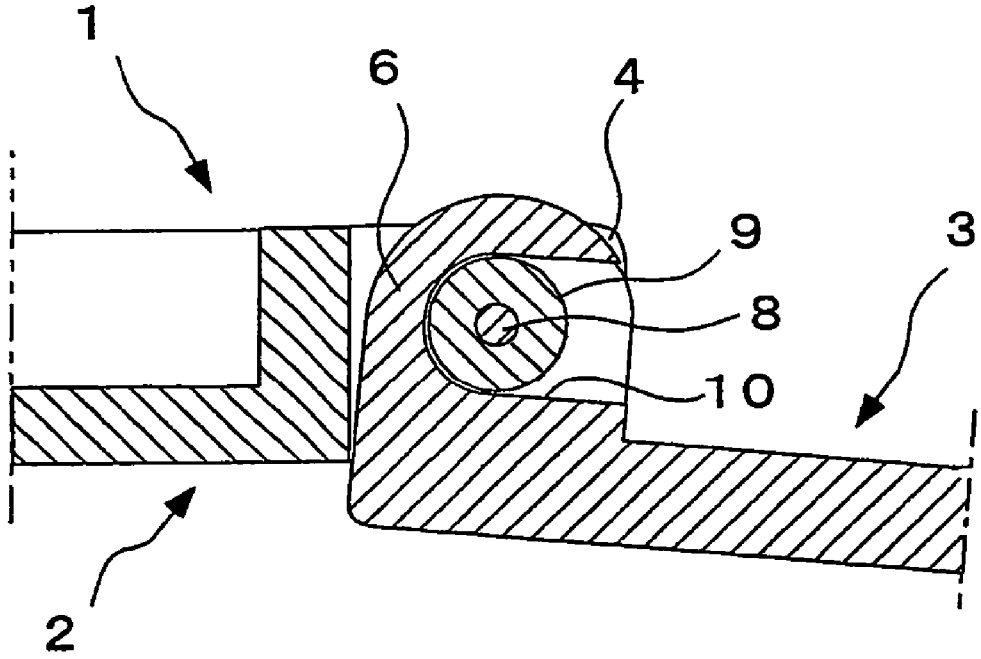
FIG. 4 is a cross-sectional side view of the hinge connectors in the embodiment shown in FIG. 1 in which the lid is in the open state.

When the compact case 1 is opened, the rear side of the second hinge connector 6 of the lid 3 may happen to butt against the rear side of the case body 2, as shown in FIG. 4. At that time, it is possible to consider that external forces may act on the hinge shafts 8 as strong shearing forces under the leverage with the butting positions serving as the point of action and with the portion of the lid 3 creating lid-opening forces as the power point. In fact, however, this external force acts on the protruded fitting parts 9 by the intermediary of the circumferential surface of the recessed fitting parts 10 and is received by the protruded fitting parts 9. Thus, the external force is unable to act on the hinge shafts 8 and causes no breakage in these shafts 8.

When the lid 3 is in the closed state, the open cut-out of the recessed fitting part 10 looks inward toward the front side of the lid 3, and the protruded fitting part 9 is completely embraced inside the recessed fitting part 10. Even if forces act unexpectedly to push up the rear side during the time when the compact case 1 is carried, the recessed fitting part 10 receives the external force without fail, and never slips away from the protruded fitting part 9. Thus, there is no possibility that shearing forces act on the hinge shafts 8.

When the compact case 1 is used up and disposed of as waste, the case body 2 and the lid 3 can be disposed of together without removing the hinge shafts 8, because the shafts 8, too, are likewise made of a similar synthetic resin. It is only necessary to remove the mirror 19, and all other components can be easily adapted for separate collection and disposal.

In the above-described embodiment of the invention, both of the first hinge connectors 4 are disposed to the right and the left, and the second hinge connector 6 is disposed in between. The first hinge connectors 4 are provided with protruded fitting parts 9, and the second hinge connector 6 is provided with the recessed fitting parts 10. One or both of these arrangements can be reversed. For example, a single first hinge connector 4 is disposed centrally, and the second hinge connectors can be disposed to the right and the left. Or the first hinge connectors 4 can be provided with recessed fitting parts 10, and the second hinge connector 6 can be provided with the protruded fitting parts 9.

As the synthetic resin used for the case body 2 and the lid 3, it is preferred to use such a synthetic resin that gives off a feel of high quality appropriate for a compact case in which to contain a cosmetic material. In this respect, a hard synthetic resin, such as polypropylene, is preferable. A synthetic resin used for the hinge shafts 8 is required to have a high strength as the shaft material. For this purpose it is preferable to use a synthetic resin having high toughness, such as nylon.

Figure 5:
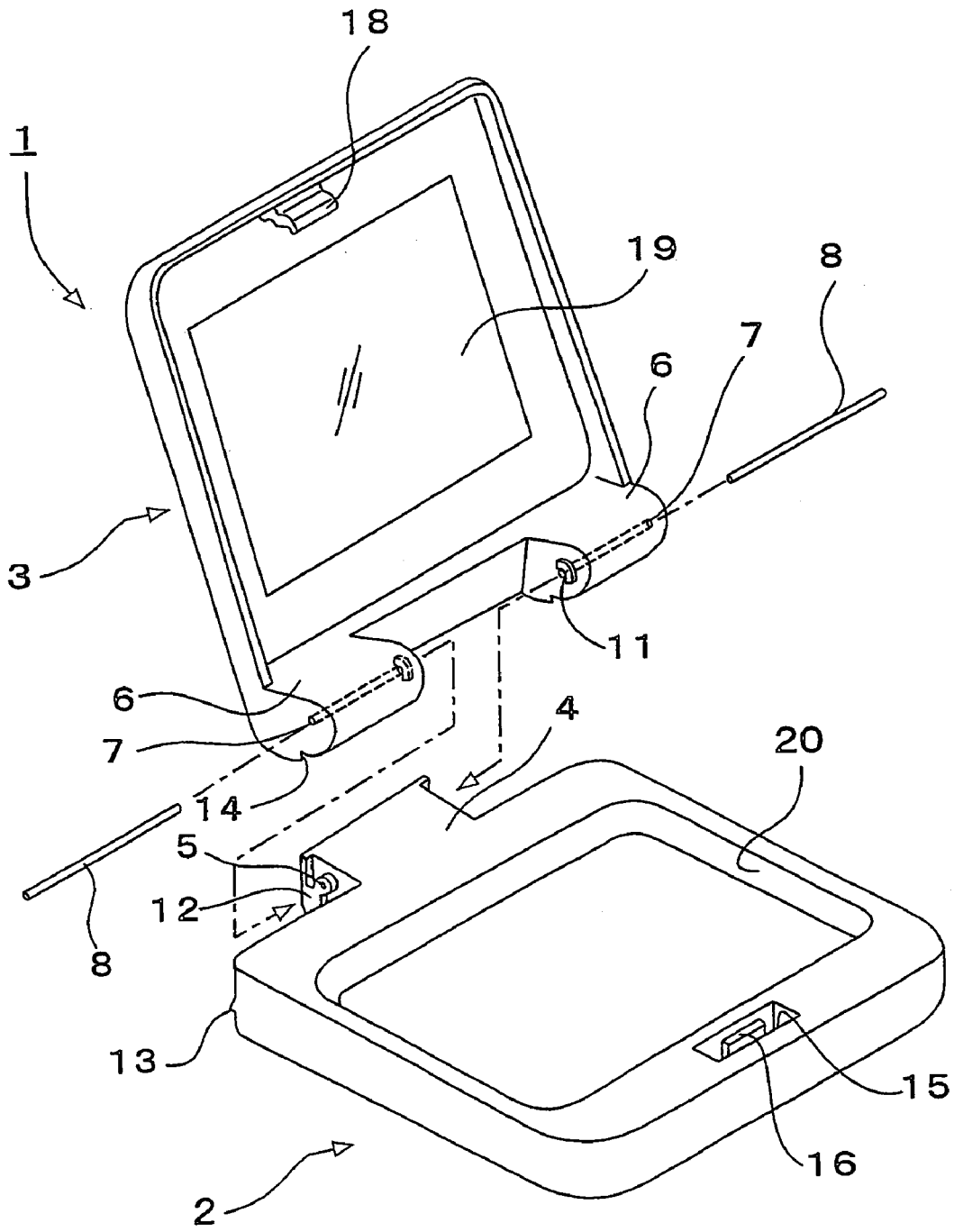
FIG. 5 is an exploded perspective view of the compact case in the second embodiment of this invention.
Figure 6:
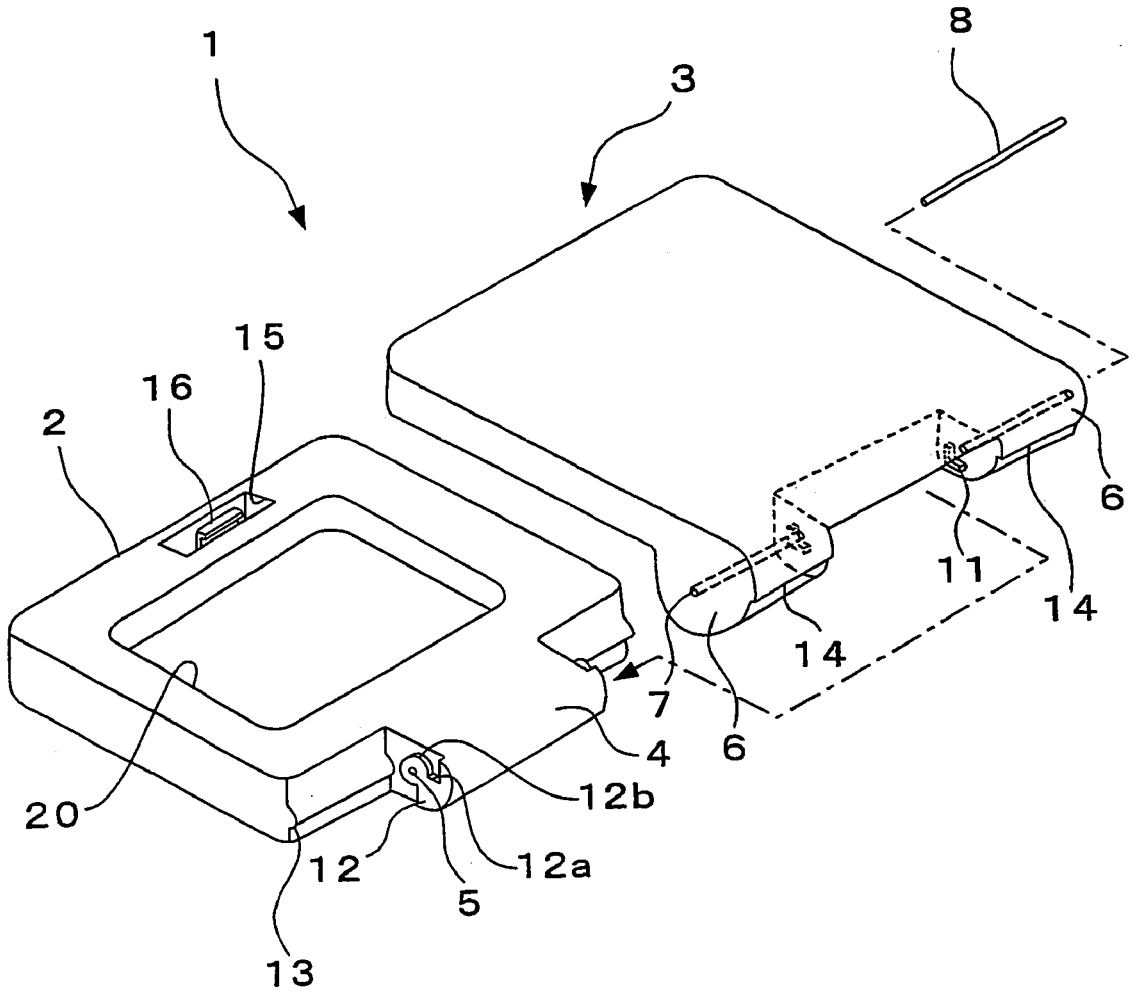
FIG. 6 is an exploded perspective view of the compact case shown in FIG. 5 as observed from behind the case.

The compact case in the second embodiment, shown in FIGS. 5-9, is described. As shown in FIGS. 5 and 6, the cosmetic compact case 1 is made of a synthetic resin, and includes the case body 2, the lid 3, and the hinge shafts 8. The case body 2 is provided with powder storage 20 and the first hinge connector 4 having the first shaft hole 5 drilled along the central axis of this connector 4. The lid 3 has a mirror 19 attached on the inner wall, and is provided with two second hinge connectors 6 having second shaft holes 7 drilled along the central axis of these connectors 6. The compact case 1 is made by combining the first hinge connector 4 of the case body 2 with the second hinge connectors 6 of the lid 3 and inserting each hinge shaft 8 through the first shaft hole 5 and the second shaft hole 7 so that the case body 2 and the lid 3 are joined together in a manner capable of opening, turning, and closing the lid 3.

A hole 15 is disposed in the central portion on the front of the case body 2. A catch 17 is provided inside this hole 15. A catch 18 is disposed so as to suspend from the central portion on the front of the lid 3. The catches 17 and 18 are engaged with each other to hold the compact case 1 in the closed state.

Figure 7:
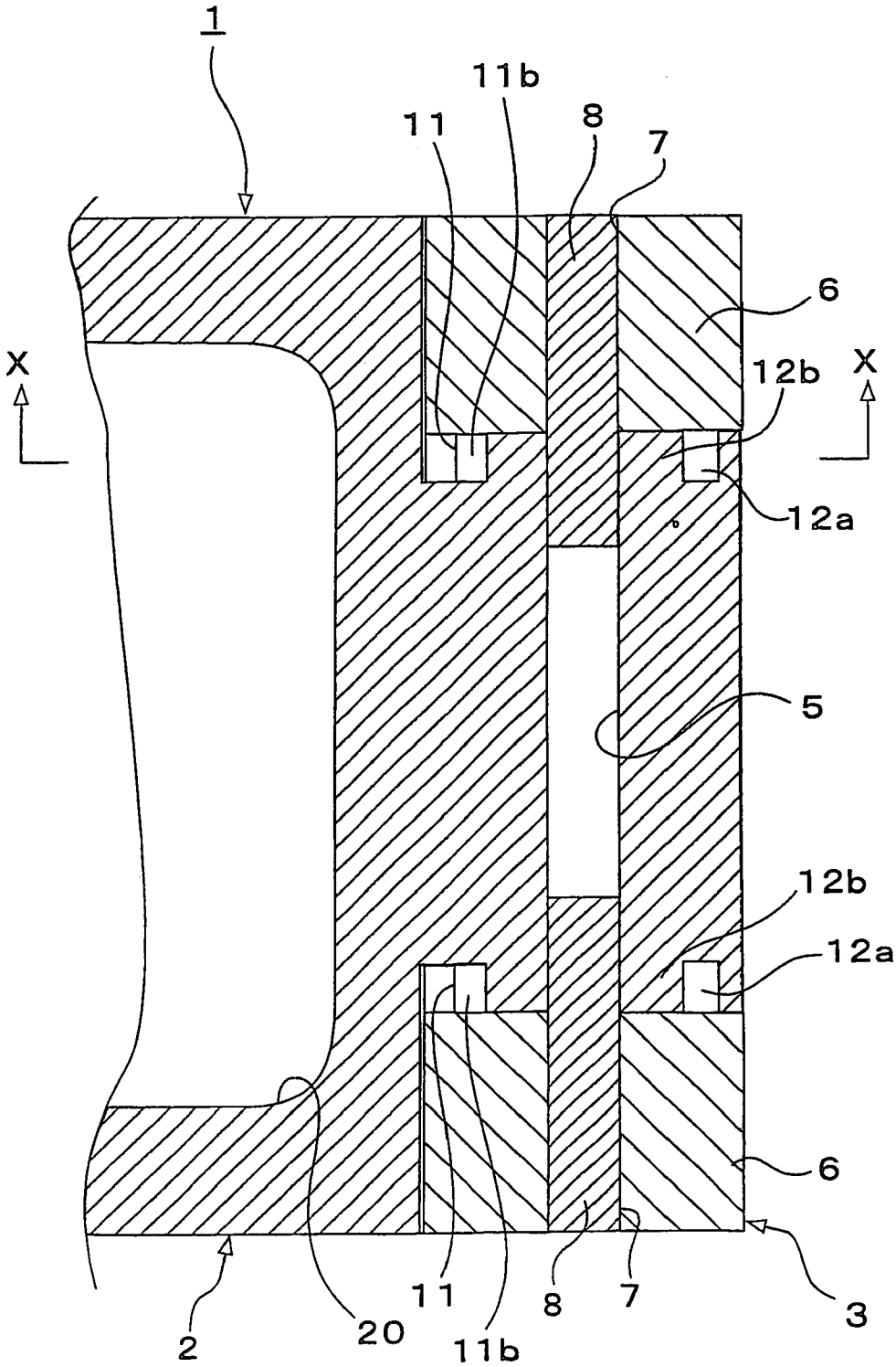
FIG. 7 is an enlarged, cross-sectional plan view of the hinge connectors of the case shown in the embodiment of FIG. 5.
Figure 8:
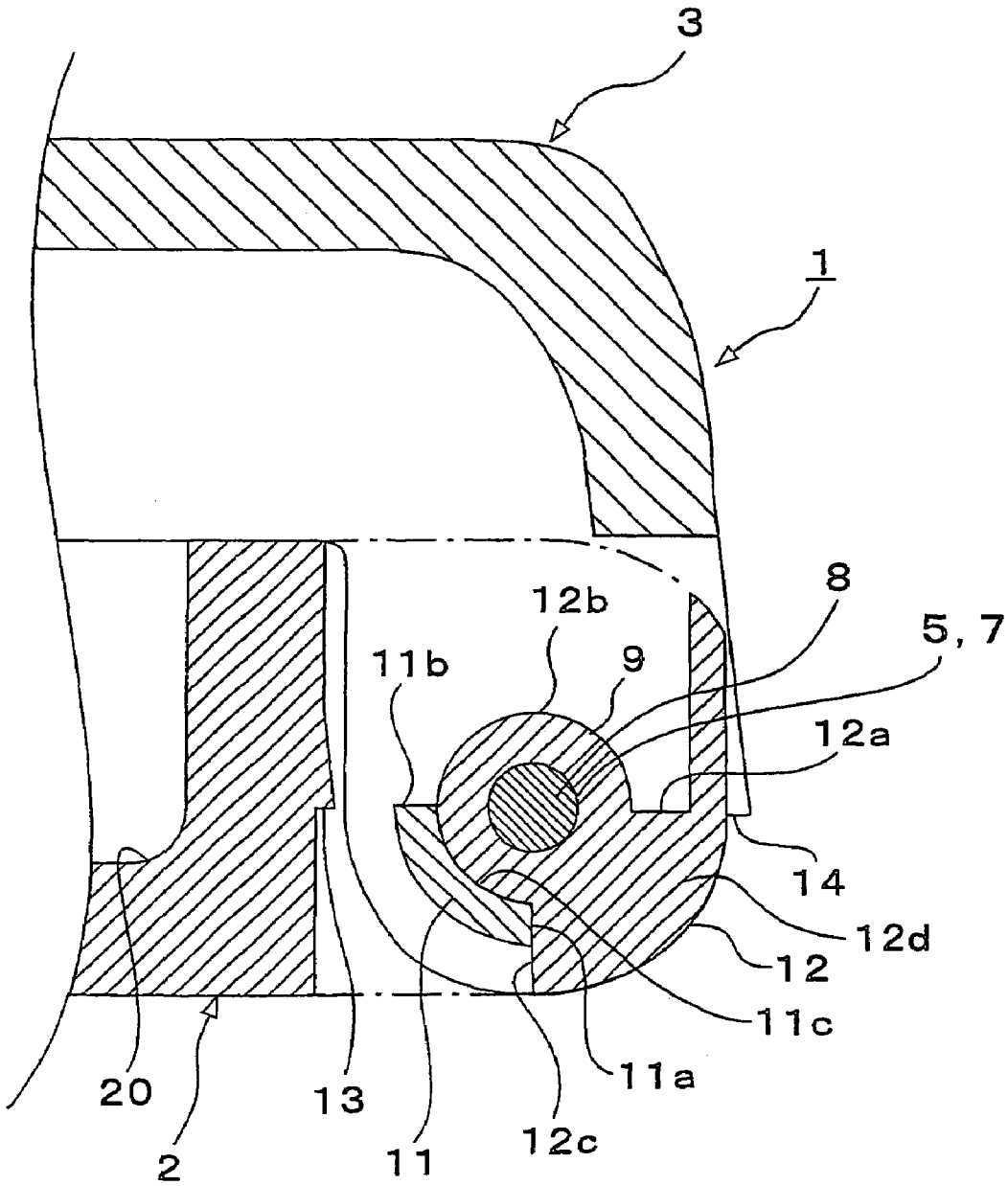
FIG. 8 is an enlarged, longitudinal section of the joined hinge connectors taken from line X-X shown in the embodiment of FIG. 7.

As shown in FIGS. 7 and 8, there is a gently tapered upward slope above the horizontal ridgeline of each overhanging ridge 13, which is disposed at the rear of the case body 2 in those parts other than where the first hinge connector 4 is located. Similarly, each of the lid stops 14 has also a smoothly and gently tapered upward slope above the horizontal ridgeline, and is disposed respectively at the rear of each second hinge connector 6 at a position opposite to the overhanging ridge 13 that has been disposed at the rear of the case body 2. Both lid stops 14 are allowed to butt against the overhanging ridges 13 from underside when the lid 3 is turned around fully to open the case 1.

Each stopping piece 11 has a shape of a fourth of a thick ring, such as a doughnut, a rectangular cross-section, and a central angle of about 90 degrees at the center of the second shaft hole 7. The two stopping pieces 11 are respectively disposed on the inner faces of the second hinge connectors 6 and are projected therefrom when the hinge connectors 6 are placed in abutment with the first hinge connector 4. Each stopping piece 11 is located on the front side of the second shaft hole 7 obliquely forward and downward, with horizontal end face 11*b* being at the same height as the center of the second shaft hole 7, inner arc surface 11*c* being an inner recessed surface, and the other end face 11*a* is disposed vertically right below the second shaft hole 7.

Stopping mechanisms 12 are provided on both end faces of the first hinge connector 4 in positions opposite to the stopping pieces 11 of the second hinge connectors 6, which are in abutment with the first hinge connector 4. Each stopping mechanism 12 includes a cylindrical ring with a radius twice as much as the curvature radius of the inner arc 11*c* of the stopping piece 11. Integrally made with this ring and disposed on the rear side of the first shaft hole 5 obliquely backward and downward is a roughly quadrantal portion having a central angle of about 90 degrees at the center of the first shaft hole 5. Top contact surface 12*a* is a horizontal flat surface located at the rear of the first shaft hole 5 and at the same height as the center of the first shaft hole 5. The vertical flat surface 12*c* is disposed under the first shaft hole 5.

The stopping mechanism 12 also comprises an upstanding piece, which is disposed at the end of the top contact surface 12*a* and is connected to each end face of the first hinge connector 4. This upstanding piece and the quadrantal portion together form a blindfolding portion 12*d*, which makes the rear side looking like that of an ordinary compact case. In addition, the blindfolding portion 12*d* prevents bad outer appearance by avoiding the complicated combination of the stopping piece 11 and the stopping mechanism 12 to become visible from outside.

Figure 9:
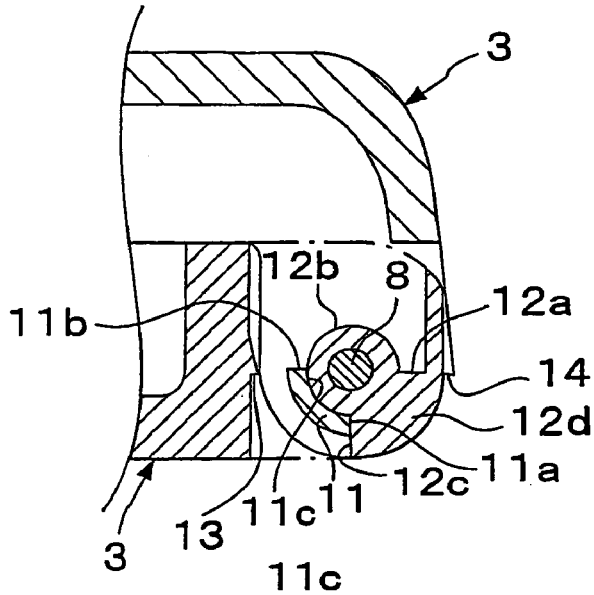
FIGS. 9(*a*), 9(*b*), and 9(*c*) are the explanatory diagrams showing the operation of the stopping piece in the embodiment of FIG. 5.
Figure 9:
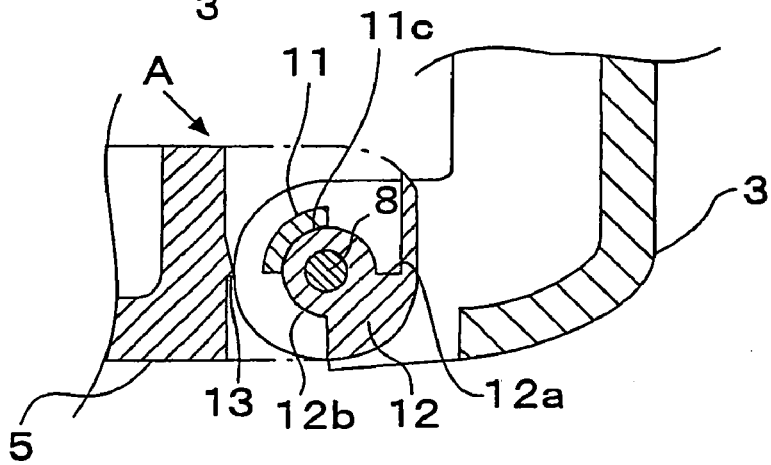
Figure 9:
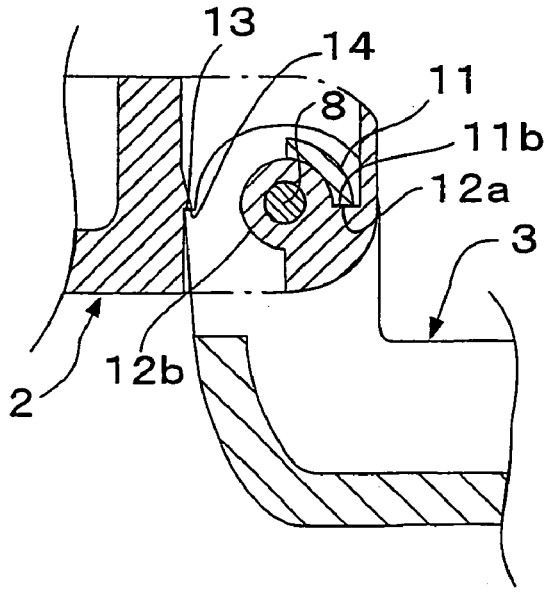
Figure 10:
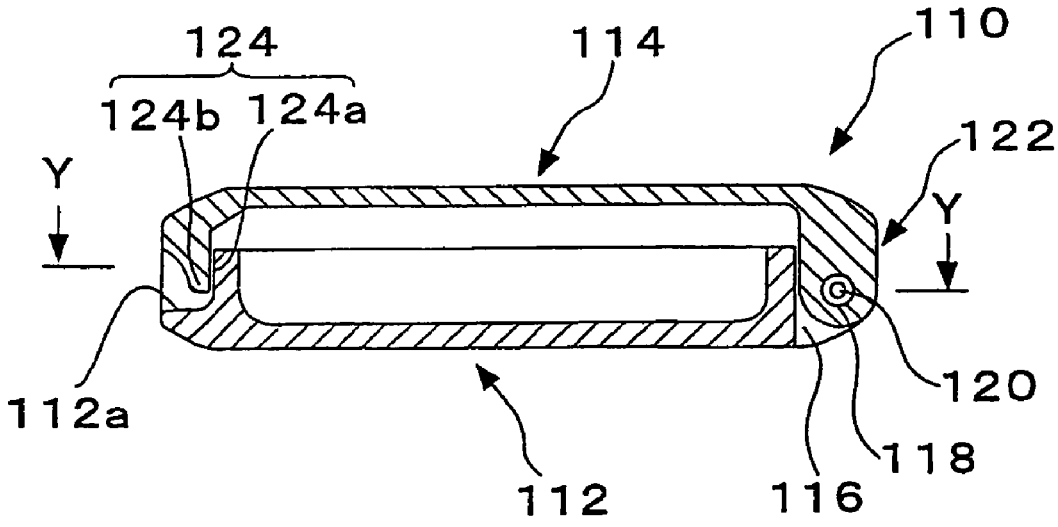
FIG. 10 is a cross-sectional side view of a compact case in one embodiment of conventional art.
Figure 11:
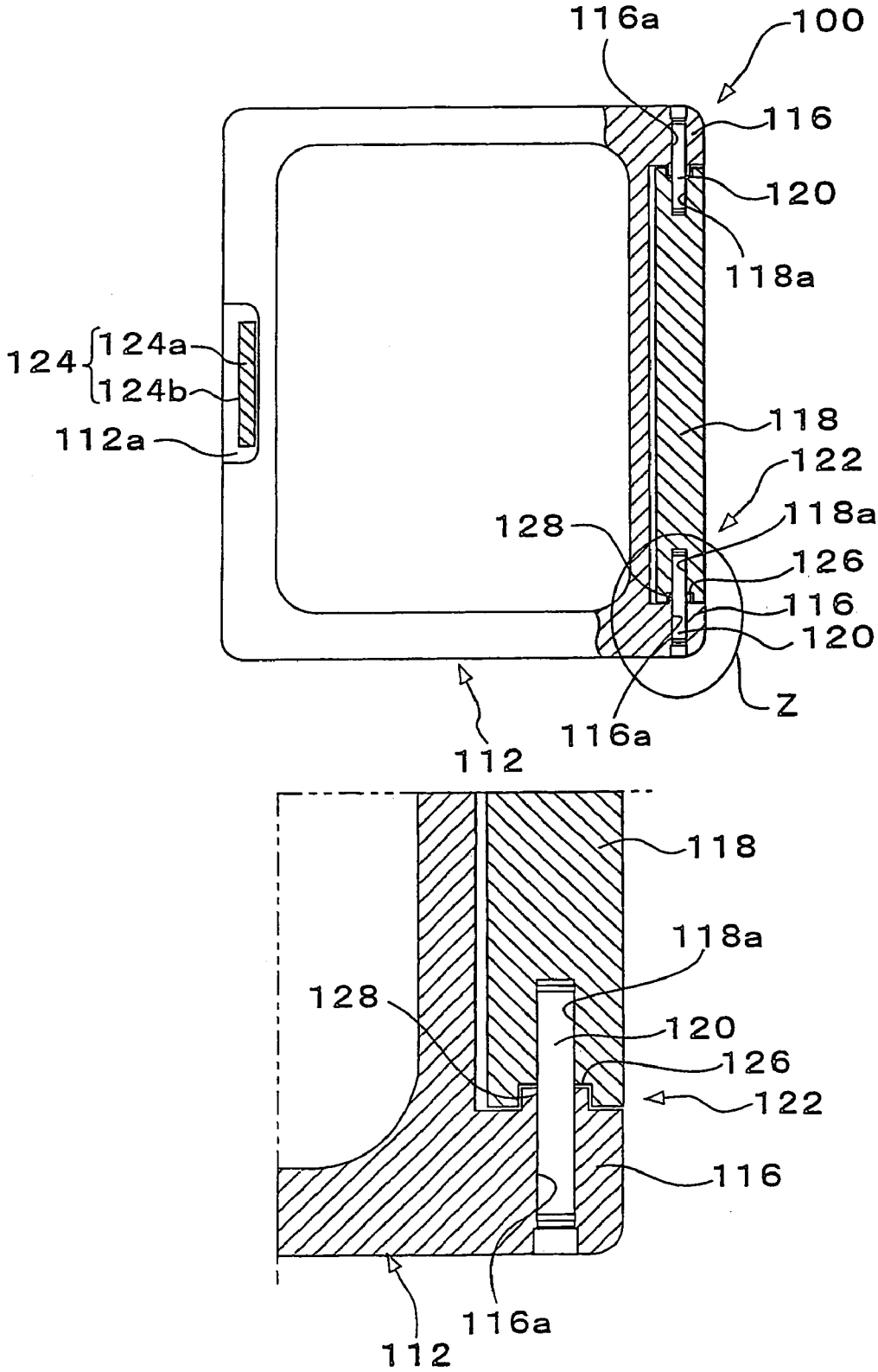
FIG. 11 is a partially cross-sectional plan view taken from line Y-Y of FIG. 10, with area Z being shown as a partially enlarged view.
Figure 12:
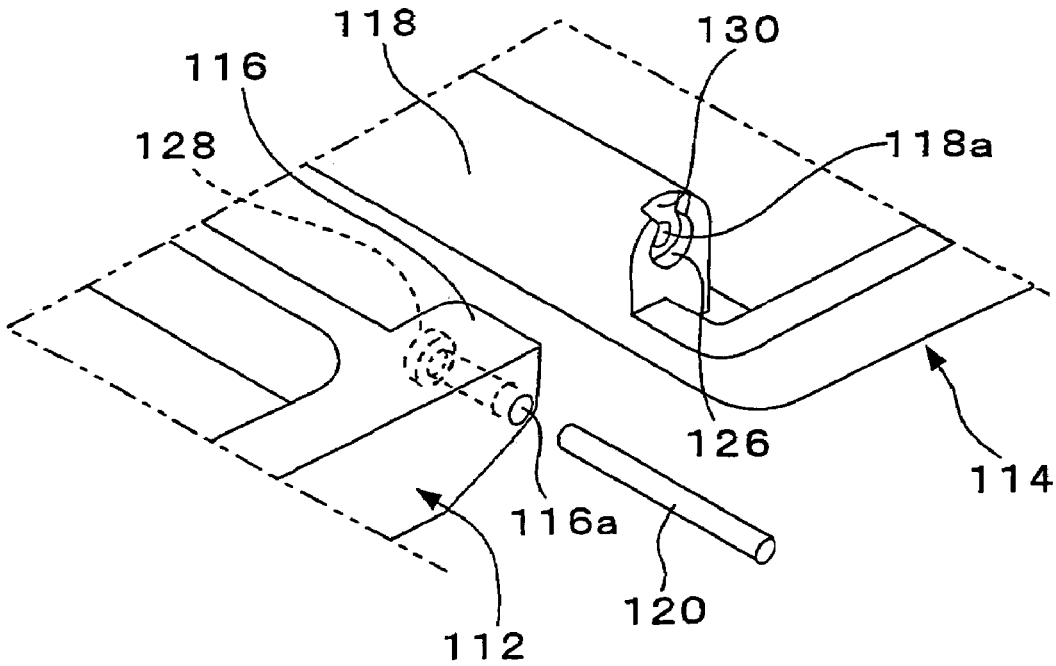
FIG. 12 is an enlarged and exploded perspective view of an important hinge portion of FIG. 10.

As shown in FIG. 9(*a*), the stopping piece 11 is disposed at a position lower than the hinge shaft 8 in the state where the lid 3 has closed the case body 2, and the end face 11*a* of the stopping piece 11 has butted against the vertical surface 12*c* of the stopping mechanism 12 in a circumferential direction.

In this state, only external forces at work on the lid 3 in the upward direction can be shearing forces that can act on the hinge shaft 8. This external force in the upward direction is received by the contact between the inner arc surface 11*c* of the stopping piece 11 and the circumferential surface 12*b* of the stopping mechanism 12, thus making it impossible for the external force to act on the hinge shaft 8 as the shearing force.

Then, when the lid 3 is turned around from the position on the case body 2, with the hinge shaft 8 serving as the axis of rotation, the inner arc surface 11*c* of the stopping piece 11 slides on the circumferential surface 12*b* of the stopping mechanism 12, and the stopping piece 11 moves along the circumferential surface 12*b*, as shown in FIG. 9(*b*).

In this state there is almost no possibility that any external force acts on the hinge shaft 8 as the shearing force. Even if external forces gave rise to shearing forces, and if this external force acted in the direction of arrowhead A, i.e., in the direction in which the stopping piece 11 is pushed toward the hinge shaft 8, the force would be received by the contact between the inner arc surface 11*c* of the stopping piece 11 and the circumferential surface 12*b* of the stopping mechanism 12, and no shearing force acts on the hinge shaft 8.

As shown in FIG. 9(*c*), the lid 3 has been turned about 180 degrees from the position on the case body 2 with the hinge shaft 8 serving as the axis of rotation. At that time, the lid stop 14 butts against the overhanging ridge 13 from underside on the front side of the hinge shaft 8. In addition, on the rear side of the hinge shaft 8, the end face 11*b* of the stopping piece 11 butts against the top contact surface 12*a* of the stopping mechanism 12 from upside. Thus, the lid 3 stops rotating relative to the case body 2. Specifically, the lid stop 14 butts against the overhanging ridge 13 from an underside, and at the same time, the end face 11*b* of the stopping piece 11 butts against the top contact surface of the mechanism 12 from an upside. The combination of the lid stop 14 with the corresponding overhanging ridge 13 is located on the other side of the combination of the stopping piece 11 with a corresponding stopping mechanism 12. The former combination is located on the front side of the hinge shaft 8, and the latter combination is located on the rear side thereof. The two butting positions, of the overhanging ridge 13 and the lid stop 14 and of the top contact surface 12*a* and the end face 11*b*, with the hinge shaft 8 existing in between, set the limit of rotation for the lid 3 relative to the case body 2.

If external forces are applied in the lid-opening direction onto the lid 3 located at the limit of rotation, then the action of leverage may be observed with the portion pushed by the external force serving as the power point and both butting positions serving as the fulcrums. However, since the hinge shafts 8 are located between both fulcrums, these hinge shafts 8 cannot become the points when the lid 3 is located at the limit of rotation where the largest shearing force tends to be at work. Thus, no shearing force is applied on the hinge shafts 8, and there is no breakage of the hinge shafts 8.

The case body 2 and the lid 3 are brought to butt against each other at two points, with the hinge shaft 8 in between, at the limit of rotation for the lid 3 relative to the case body 2. The contact in these two points completely prevents the hinge shafts 8 from receiving the shearing force caused by the external force that makes the lid 3 turn around further in the opening direction. Thus, the hinge shafts 8 can be protected against fracture, and the case 1 has improved durability and safety.

The inner arc surface 11*c* of the stopping piece 11 is in sliding contact with the circumferential surface 12*b* of the stopping mechanism 12 when the lid 3 is turned round from the case body 2. Even if external forces are applied so as to push the stopping piece 11 toward the hinge shaft 8, this external force can be prevented from acting on the hinge shaft 8 as a shearing force, because the circumferential surface 12*b* of the stopping mechanism 12 receives the external force applied on the stopping piece 11. As a result, the hinge shafts 8 can be prevented from the shearing fracture during the opening and closing operations of the lid 3.

INDUSTRIAL APPLICABILITY

As obvious from the foregoing description, the technical problem of this invention is to protect the hinge shafts of a synthetic resin against an external force acting as strong shearing forces under the leverage that may be applied when the lid comes to the opening limit of a hinge structure used in a compact case. The object of this invention is to ensure that the hinge shafts are prevented from being broken so that the case will have improved durability and safety.

The invention claimed is:

1. A hinge structure of a case, intended to join a synthetic resin case body and a synthetic resin lid together in a manner capable of opening, turning, and closing said lid, said hinge comprising:

a first hinge connector, including a first shaft hole, disposed at a rear of said synthetic resin case body having powder storage;

second hinge connectors, including second shaft holes, disposed at the rear of said synthetic resin lid that opens or closes the case body;

two hinge shafts made of a synthetic resin, with each of said hinge shafts being inserted through said first shaft hole and said second shaft hole;

overhanging ridges disposed at the rear of the case body in left and right parts other than where said first hinge connector is located;

lid stops disposed respectively at the rear of the second hinge connectors at positions opposite to said overhanging ridges that have been disposed at the rear of the case body and are allowed to butt against said overhanging ridges from an underside when the lid is turned around fully on the case body;

stopping pieces disposed at inner ends of the second hinge connectors of the lid, with said connectors being located in abutment with said first hinge connector; and stopping mechanisms disposed on both end faces of the first hinge connector of the case body at positions opposite to, and in contact with, said stopping pieces to allow each of said stopping pieces to butt against a top contact surface of said stopping mechanisms from an upside when the lid is turned around fully on the case body.

2. The hinge structure of the case according to claim 1, wherein at least one of said stopping mechanisms is provided with a circumferential surface, which comes into sliding contact with at least one of the stopping pieces within a range in which the lid is turned around relative to the case body.

* * * * *